US005335606A

United States Patent [19]

Whitehead et al.

[11] Patent Number: 5,335,606

[45] Date of Patent: Aug. 9, 1994

[54] INTERLOCKING SHELVING UNIT

[76] Inventors: Verlon E. Whitehead, Austin; Ronald E. Hunt, Georgetown, both of Tex.

[21] Appl. No.: 489

[22] Filed: Jan. 5, 1993

[51] Int. Cl.[5] ..... A47B 3/00

[52] U.S. Cl. ..... 108/181; 108/91

[58] Field of Search ..... 108/111, 153, 91, 53.1, 108/53.3, 53.5, 180, 181, 91

[56] References Cited

U.S. PATENT DOCUMENTS

| | | | |
|---|---|---|---|
| 1,252,816 | 1/1918 | Kuehl | 108/91 X |
| 2,175,326 | 10/1939 | Thompson | 108/91 |
| 3,491,896 | 1/1970 | Crary | 108/111 |
| 4,301,743 | 11/1981 | Keller | 108/83.1 |
| 4,485,930 | 12/1984 | Savelkouls | 108/91 X |
| 4,703,702 | 11/1987 | Speicher | 108/53.1 |
| 4,709,640 | 12/1987 | Jouanin | 108/91 |
| 4,714,027 | 12/1987 | Stern | 108/111 |

FOREIGN PATENT DOCUMENTS

| | | | |
|---|---|---|---|
| 1455582 | 11/1976 | United Kingdom | 108/91 |

*Primary Examiner*—Jose V. Chen

*Attorney, Agent, or Firm*—Grady K. Bergen; Andrew J. Dillon

[57] ABSTRACT

A set of shelving units which can be interlockingly mated together. Each shelving unit has a set of end panels is provided with substantially identical dimensions. At least one elongated cross member is joined to an edge of the end panels so that the end panels are spaced apart along the length of the cross member. At least two elongated cross members are joined to an opposite edge of the end panels. The two cross members are parallel and spaced apart to form a gap for receiving a cross member of a second shelving unit similarly constructed so that the shelving units can be interlockingly mated. The cross members of each shelf form a shelving surface.

8 Claims, 2 Drawing Sheets

INTERLOCKING SHELVING UNIT

BACKGROUND OF THE INVENTION

1. Field of the Invention

This invention relates to an improved set of shelving units which can be interlockingly mated together. Each shelving unit may be utilized independently. Each shelving unit includes elongated cross members which are spaced apart in order to receive elongated cross members of a second shelving unit to form a shelf.

2. Description of the Prior Art

There are a number of modular shelving units which can be interlocked to form a set of shelves. These shelving units generally allow each shelf to be locked in only one position so that there is no lateral movement. The shelving units usually consist of several different components that must be assembled together. The shelving units generally have separate legs or end panels which are attached or inserted into a lower shelf or shelving unit. A shelf is then interlocked with the top of the legs or end panels. If necessary, more legs or end panels can be placed on this shelf and other shelves added so that several shelving units are joined together to form the set of shelves.

SUMMARY OF THE INVENTION

This invention consists of a set of shelving units which can be interlockingly mated together. Each shelving unit has a set of end panels with identical dimensions. Each end panel has a first edge to which at least one elongated cross member is joined. At least two elongated cross members are joined to an opposite second edge of the end panels and are spaced apart so that there is a gap between each cross member. The gap is wide enough to receive the elongated cross member attached to the first edge of the end panels of a second shelving unit, which is similarly constructed, so that the shelving units are interlockingly mated.

DETAILED DESCRIPTION OF THE INVENTION

Figure 1:
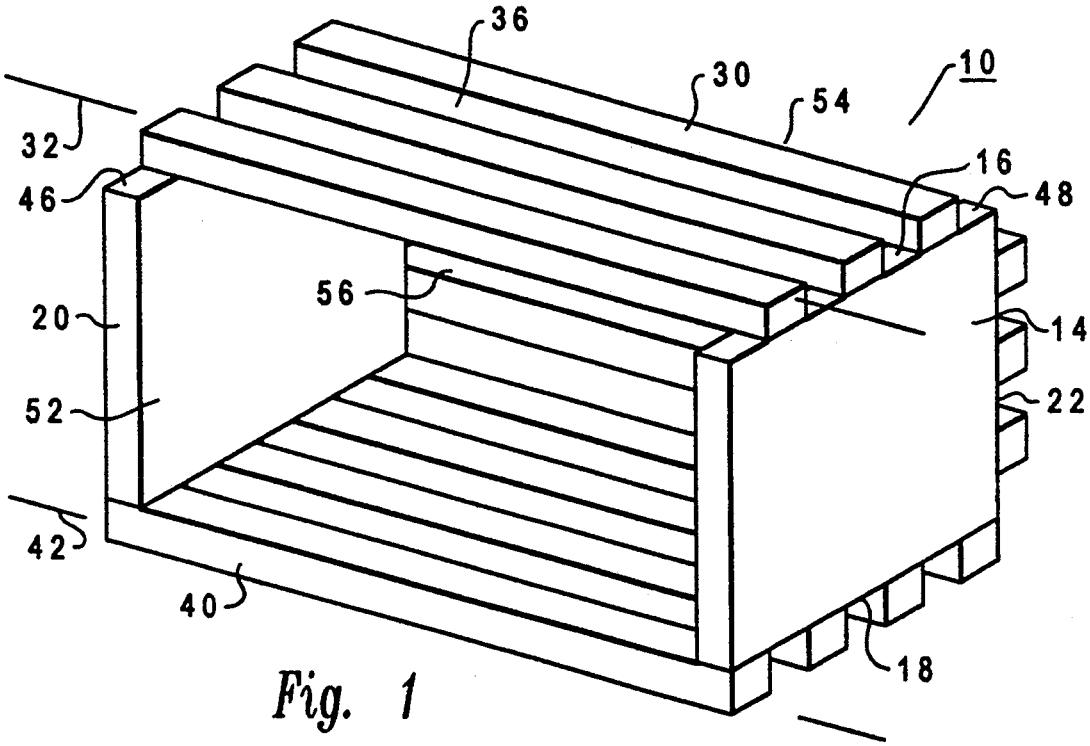
FIG. 1 is a front perspective view of a shelving unit constructed in accordance with this invention.

FIG. 1 shows the shelving unit 10 of the invention. The shelving unit 10 has a set of end panels 14 which have substantially identical dimensions. Each end panel 14 has an upper edge 16 and an opposite lower edge 18. The end panels 14 are substantially square or rectangular and have a front edge 20 and a back edge 22. Each end panel 14 is a flat, solid member. The end panels 14 are preferably located in parallel planes.

Figure 2:
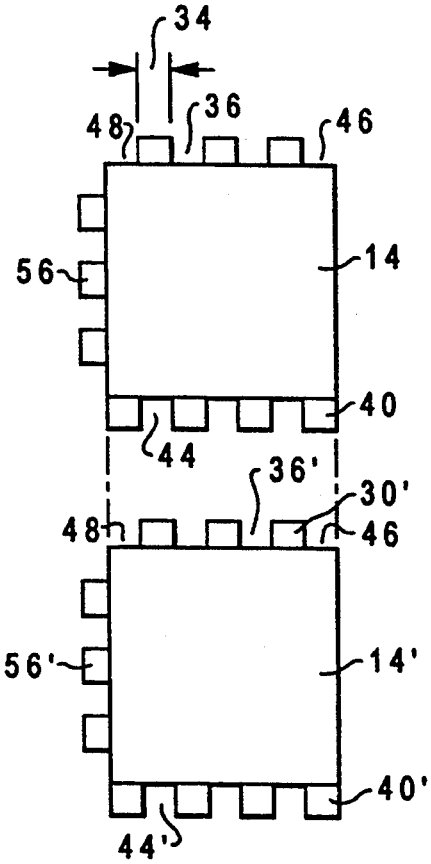
FIG. 2 is a side view of the shelving unit of FIG. 1 and a side view of a second shelving unit constructed in the same manner as the shelving unit of FIG. 1, shown prior to placing the first shelving unit in the second shelving unit.

A plurality of identical upper elongated cross members 30 are joined to the upper edges 16 of the end panels 14. Each upper cross member 30 has a longitudinal axis 32 which extends along the length of the cross member 30. The upper cross members 30 have a substantially rectangular transverse cross section. The end panels 14 are spaced apart along the longitudinal axis 32, the end panels 14 being perpendicular to the cross members 30. As shown in FIG. 2, each upper cross member 30 has a transverse width 34. The upper cross members 30 are spaced apart from each other along the upper edge 16 of the end panel 14 to provide a gap 36. Each gap 36 is substantially equal in dimension to each width 34 of each cross member 30.

Referring to FIG. 1, there are a plurality of identical lower elongated cross members 40 joined to the lower edge 18 of the end panels 14. Each lower elongated cross member 40 has a substantially rectangular transverse cross section and has a longitudinal axis 42 extending along the length of the cross member 40. The lower cross members 40 are perpendicular to the end panels 14. As shown in FIG. 2, the lower cross members 40 are spaced apart from each other along the lower edge 18 of the end panel 14 so that a gap 44 is formed between each lower cross member 40. The gap 44 has a distance equal to the width 34 of one of the upper cross members 30. The lower cross members 40 are identical to the upper cross members 30, except there is one more lower cross member 40 than the upper cross members 30.

A space or gap 46 equal to gap 36 locates between the front upper cross member 30 and the front edge 20. Similarly, a space or gap 48 equal to gap 36 locates between the back upper cross member 30 and the rearward edge 22. The front lower cross member 40 is flush with the front edge 20. The back lower cross member 40 is flush with back edge 22.

The front 52 of the shelving unit 10 is open to allow objects to be placed inside the shelving unit 10. The back 52 of the shelving unit 10 has back cross members 54, which are attached to the back edge 22 of the end panels 14, to prevent objects from falling from the shelving unit 10. The back 52 could also consist of a solid, single cross piece or panel (not shown).

Depending upon the materials used, the cross members 30, 40 and 54 may be joined to the end panels 14 by gluing cross members 30, 40, 54 to the end panels 14, or by using appropriate fasteners such as nails or screws.

Referring to FIG. 2, a lower second shelving unit designated by the numeral 10' is constructed in the same manner as the shelving unit 10 shown in FIG. 1. The second shelving unit 10' has similar components which are designated by means of a prime symbol with the numbers corresponding to the number of the components of the shelving unit 10 in FIG. 1.

Figure 3:
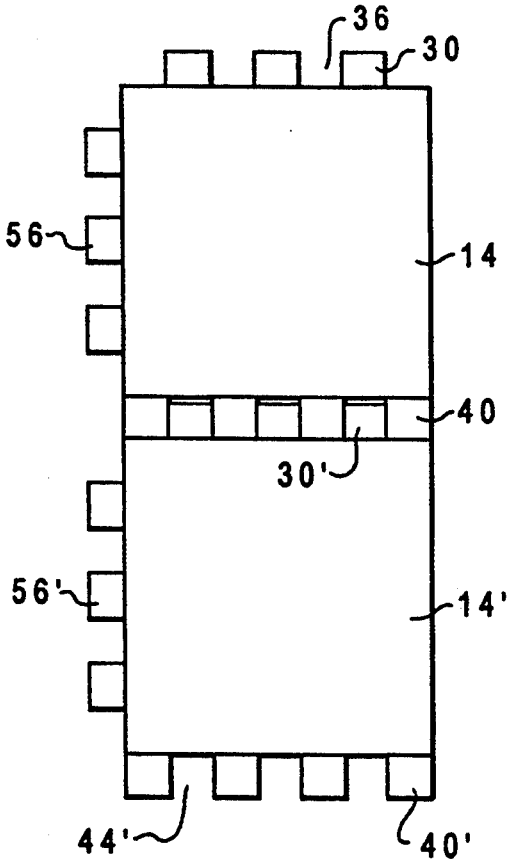
FIG. 3 is a side view of the shelving units of FIG. 2 shown interlockingly mated.

As can be seen in FIG. 2, the upper cross members 30' of shelving unit 10' have a width 34' which corresponds to the gap 44 between each of the lower cross members 40 of the first shelving unit 10. The distance of the gap 44 is slightly greater than the width 34' of the upper cross members 30' of the second shelving unit 10' so that each gap 44 can receive one of the members 30' and the shelving units can be interlockingly mated or engaged. Similarly, the spaces 46', 48' located on the upper edge 16' receive the front and back lower cross members 40. FIG. 3 shows a side view of the shelving unit 10 and second shelving unit 10' interlockingly mated.

Figure 4:
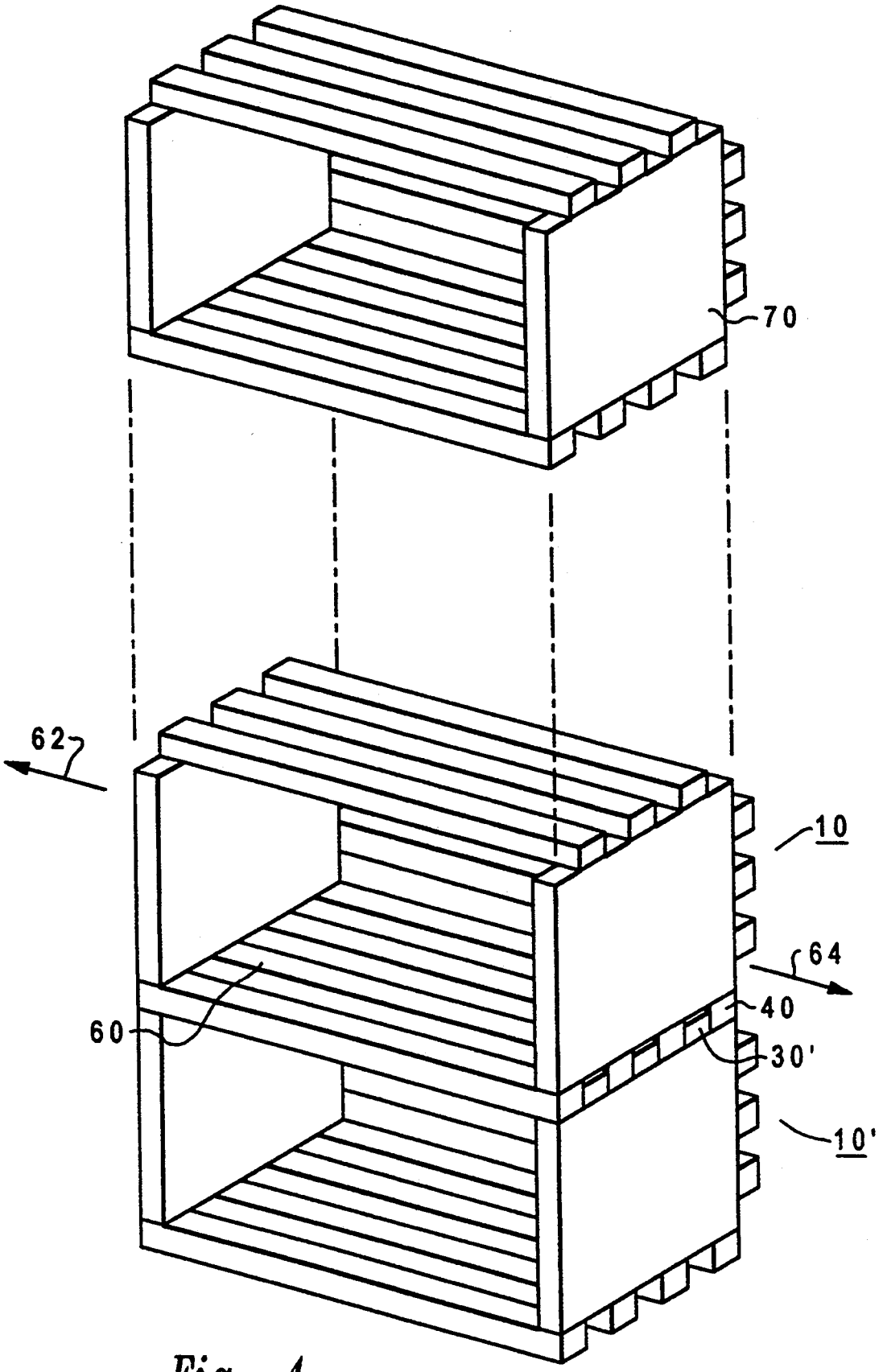
FIG. 4 is a perspective view of the shelving units of FIGS. 1 and 2 shown interlockingly mated, and a third shelving unit constructed in accordance with this invention shown prior to mating with the first two shelving units.

Referring to FIG. 4, first shelving unit 10 is shown interlocking mated with the second shelving unit 10'. When interlockingly mated, the lower cross members 30 of the first shelving unit 10 and the upper cross members 40' of the second shelving unit 10' form a floor shelf 60 which has no gaps. Because the upper and lower cross members 30', 40 are parallel, the shelving unit 10 may be moved along longitudinal lines 62, 64 to desired positions in relation to shelving unit 10'. An upper third shelving unit 70 may also be placed on shelving unit 10 in the same manner as described above. It should be noted that several shelving units could be interlockingly mated together to form a set of shelves. The shelving units could also be of different lengths so that more than one shorter shelving unit could be positioned along the upper or lower cross members of a single longer shelving unit. The shelving units are simply stacked together and need not be secured by fasteners or glue.

In operation, the first shelving unit 10 is aligned so that the lower cross members 40 are parallel to the upper cross members 30' of the second shelving unit 10'. The lower cross members 40 of the shelving unit 10 are then positioned over the gaps 36' and lowered until the lower cross members 40 of shelving unit 10 contact the upper edge 16' of the second shelving unit 10' as shown in FIG. 3. The shelving unit 10 may then be laterally adjusted by sliding shelving unit 10 along lines 62 or 64 (FIG. 4) to the desired position in relation to shelving unit 10'.

There are several advantages to this invention. Each shelving unit can be utilized as an independent shelf with the upper or lower cross members forming a shelf, or the shelving units may be interlockingly mated together to form a set of shelves. The shelving units are interchangeable so that one shelving unit can be used as an upper or lower shelving unit. The shelves may be moved to various positions along lines parallel to the cross members.

Another advantage is that there are no separate parts or components which must be attached in order to join the shelving units together. Each shelving unit is independent and is easily joined to another shelving unit merely by stacking it on top or below a shelving unit which is similarly constructed. There are no separate legs or end panels which must be assembled.

While the invention has been shown in only one of its forms, it should be apparent to those skilled in the art that it is not so limited, but is susceptible to various changes without departing from the scope of the invention.

We claim:

1. A set of shelving units which can be interlockingly mated together and wherein each said shelving unit is removable from the other of said shelving units, each of said shelving units comprising in combination:

at least two end panels having substantially identical dimensions to each other, each having a first edge and an opposite second edge;

at least one elongate cross member joined to said first edge of each of said at least two end panels, said at least one elongate cross member having a longitudinal axis and a width, said at least two end panels being spaced apart along said longitudinal axis thereof; and at least two elongate cross members joined to said opposite second edge of each of said at least two end panels, said at least two elongate cross members having a longitudinal axis and being parallel and spaced apart from each other, forming a gap having a dimension substantially equal to said width of said at least one elongate cross member, wherein said gap closely receives said at least one elongate cross member of a second shelving unit similarly constructed so that said shelving unit is interlockingly mated with said second shelving unit; and wherein said at least two elongate cross members are parallel to said at least one elongate cross member of said second shelving unit and contact at least one said first edge of said at least two end panels of said second shelving unit when interlockingly mated, so that each shelving unit can slide to a desired position relative to the other along lines parallel to said longitudinal axis of said elongate cross members thereof.

2. The shelving unit of claim 1, wherein:

said at least two elongate cross members of said shelving unit and said at least one elongate cross member of said second shelving unit form a shelf, free of said gaps, when said shelving unit and said second shelving unit are interlockingly mated.

3. The shelving unit of claim 1, wherein:

there are a plurality of elongate cross members joined to said first edge of each of said at least two end panels; and there are at least one more elongate cross members joined to said opposite second edge of each of said at least two end panels than said plurality of elongate cross members jointed to said first edge of each of said at least two end panels.

4. The shelving unit of claim 1, wherein:

said at least two end panels are located in parallel planes.

5. The shelving unit of claim 1, wherein:

said elongate cross members are perpendicular to said at least two end panels.

6. A set of shelving units which can be interlockingly mated together and wherein each said shelving unit is removable from the other of said shelving units, each of said shelving units comprising in combination:

at least two parallel end panels having substantially identical dimensions, each having a first edge and an opposite second edge;

a plurality of identical first elongate cross members joined to said first edge of each of said at least two end panels, said first elongate cross members being perpendicular to said at least two end panels, each of said first elongate cross members having a longitudinal axis and a width, said at least two end panels being spaced apart along said longitudinal axis thereof, said first cross members being spaced apart from each other by a first gap equal in dimension to said width; and a plurality of identical second elongate cross members joined to said opposite second edge of each of said at least two end panels, said second elongate cross members being perpendicular to said at least two end panels, each of said second elongate cross members being parallel to and spaced apart from each other, forming at least two second gaps, each having a dimension equal to said widths of said first elongate cross members, wherein each of said second gaps receives one of said first elongate cross members of a second shelving unit similarly constructed, so that said shelving unit is interlockingly mated with said second shelving unit, wherein said second elongate cross members of said shelving unit and said first elongate cross members of said second shelving unit form a shelf free of any gaps; wherein there is one more of said second elongate cross members than all said first elongate cross members;

wherein said at least two end panels have front and back edges;

wherein said first elongate cross members are spaced from said front and back edges by front and back gaps equal in dimension to said first gap; and wherein one of said second elongate cross members is flush with said front edges of said at least two end panels, and one of said second elongate cross members is flush with said back edges of said at least two end panels.

7. The shelving unit of claim 6, wherein:

each said elongate cross member has a substantially rectangular cross section.

8. A method of interlockingly mating a set of shelving units together wherein each said shelving unit is removable from the other of said shelving units, the method comprising in combination:

providing at least two end panels having substantially identical dimensions to each other, each having a first edge and an opposite second edge;

providing at least one elongate cross member joined to said first edge of each of said at least two end panels, said at least one elongate cross member having a longitudinal axis and a width, said at least two end panels being spaced apart along said longitudinal axis thereof;

providing at least two elongate cross members joined to said opposite second edge of each of said at least two end panels, said at least two elongate cross members having a longitudinal axis and being parallel and spaced apart from each other, forming a gap having a dimension substantially equal to said width of said at least one elongate cross member; then positioning said at least one elongate cross member of a second shelving unit similarly constructed within said gap of said shelving unit so that said at least two elongate cross members of said shelving unit contact at least one of said first edges of said at least two end panels of said second shelving unit so that said shelving unit is interlockingly mated with said second shelving unit; and sliding said shelving unit along lines parallel to said longitudinal axes of said elongate cross members to a desired position relative to said second shelving unit while interlockingly mated.

* * * * *